US005890231A

United States Patent [19]

Ueda

[11] Patent Number: 5,890,231

[45] Date of Patent: Apr. 6, 1999

[54] CLOTHES SUITABLE FOR SPORTING WEAR

[76] Inventor: Koreaki Ueda, No.302, G Building., 3-23, Kamiarata-cho, Kagoshima-shi, Kagoshima, 890, Japan

[21] Appl. No.: 856,402

[22] Filed: May 14, 1997

Related U.S. Application Data

[62] Division of Ser. No. 429,119, Apr. 26, 1995, abandoned.

[30] Foreign Application Priority Data

Apr. 28, 1994 [JP] Japan ..... 6-091623

[51] Int. Cl.[6] ..... A41D 1/08; A41D 27/10

[52] U.S. Cl. ..... 2/227; 2/238; 2/69; 2/125

[58] Field of Search ..... 2/227, 269, 238, 2/69, 228, 232, 83, 79, 404, 407, 125; 128/882, 873; D2/720, 738, 742

[56] References Cited

U.S. PATENT DOCUMENTS

| | | | |
|---|---|---|---|
| D. 353,255 | 12/1994 | Rodrigues | D2/828 |
| 945,980 | 1/1910 | Paradis . | |
| 1,182,425 | 5/1916 | Rubinstein . | |
| 1,462,515 | 7/1923 | McElroy . | |
| 1,489,046 | 4/1924 | Thompson . | |
| 1,581,570 | 4/1926 | Frankel | 2/227 |
| 2,087,763 | 7/1937 | Liebmann | 2/70 |
| 4,190,908 | 3/1980 | Herskind | 2/227 |
| 4,215,435 | 8/1980 | Miele | 2/227 |
| 4,766,613 | 8/1988 | Wells | 2/269 |
| 4,894,867 | 1/1990 | Ceravolo et al. | 2/238 |
| 4,914,756 | 4/1990 | Grassick | 2/238 |
| 5,088,116 | 2/1992 | Gould | 2/227 |
| 5,191,659 | 3/1993 | Backus | 2/227 |
| 5,201,075 | 4/1993 | Svetich | 2/108 |
| 5,315,716 | 5/1994 | Baum | 2/227 |
| 5,649,328 | 7/1997 | Martin | 2/227 |

FOREIGN PATENT DOCUMENTS

| | | | |
|---|---|---|---|
| 451955 | 10/1948 | Canada | 2/227 |
| 2449414 | 10/1980 | France | 2/269 |
| 1757592 | 8/1992 | U.S.S.R. . | |

*Primary Examiner*—Amy B. Vanatta
*Attorney, Agent, or Firm*—Elman & Associates

[57] ABSTRACT

Clothes suitable for sporting wear are manufactured as those clothing an upper part of a body such as a sweatshirt and an undershirt or those clothing a lower part of a body such as a pair of shorts and a pair of training pants. The sleeves of upper part of body clothes have different lengths. The trouser legs of lower part of body clothes have different lengths. This realizes clothes which allow most effective limbs to move more effectively without the wearer having to roll-up a sleeve or a trouser leg every time on site.

12 Claims, 4 Drawing Sheets

CLOTHES SUITABLE FOR SPORTING WEAR

This application is a divisional of U.S. application Ser. No. 08/429,119, filed Apr. 26, 1995, now abandoned.

FIELD OF THE INVENTION

This invention relates to clothes and more paricularly to fashionable clothes suitable for sporting wear.

DESCRIPTION OF THE RELATED ARTS

Ready-made clothes for sale in a marketplace, including shirts, for example, a polo shirt and a T-shirt, and trousers, for example, shorts, breeches and slacks, have conventionally been designed and manufactured symmetrical with the left side being identical to the right side, without any deviation construction.

A sports player is often seen playing with one side of his or her shirt sleeves or trouser legs rolled up to allow his or her most effective limb more freedom of movement.

However, in so doing, it has been necessary to take a time-consuming step, for example, of physically rolling up part of the clothes every time on site, or of pinning or otherwise securing the rolled-up part of the clothes to prevent them subsequently unrolling.

SUMMARY OF THE INVENTION

This invention aims to provide clothes suitable for sporting wear and capable of maintaining a state in which most effective limbs have more freedom of movement of players of baseball, softball, golf and cricket, etc.

This invention constructs clothes intentionally asymmetrical, thus allowing the left and right sides to be of different lengths. For example, it allows the length of a left sleeve to be made different from that of a right sleeve, or the length of a left trouser leg to be made different from that of a right trouser leg.

Clothes having a shorter sleeve on the side of a most effective arm or a shorter trouser leg on the side of a most effective leg have an advantage of allowing the pertinent limb to have more freedom of movement.

BRIEF DESCRIPTION OF THE DRAWINGS

One of an ordinary skill in the art may easily understand additional features and objects of this invention from the description of the preferred embodiments and the attached drawings.

In the drawings:

FIG. 1A shows its plane view with it being fully opened out and FIG. 1B shows its plane view with it being folded along its center line;

FIG. 2A shows its plane view with it being fully opened out and FIG. 2B shows its plane view with it being folded along its center line;

FIG. 3A shows its plane view with it being fully opened out and FIG. 3B shows its plane view with it being folded along its center line; FIG. 4A shows its plane view with it being fully opened out and FIG. 4B shows its plane view with it being folded along its center line.

DESCRIPTION OF THE PREFERRED EMBODIMENTS

The following is a description of the preferred embodiments of this invention, which are explained in detail with reference to the attached drawings.

Figure 1A:
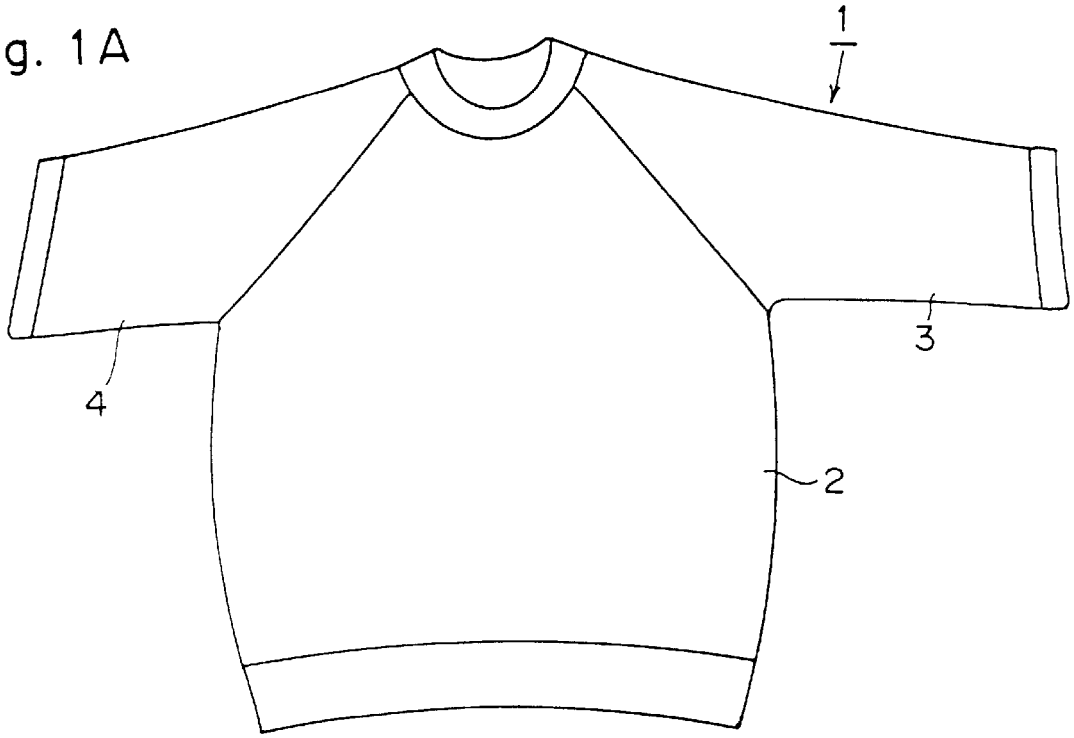
FIGS. 1A and 1B show a sweatshirt, where
Figure 1B:
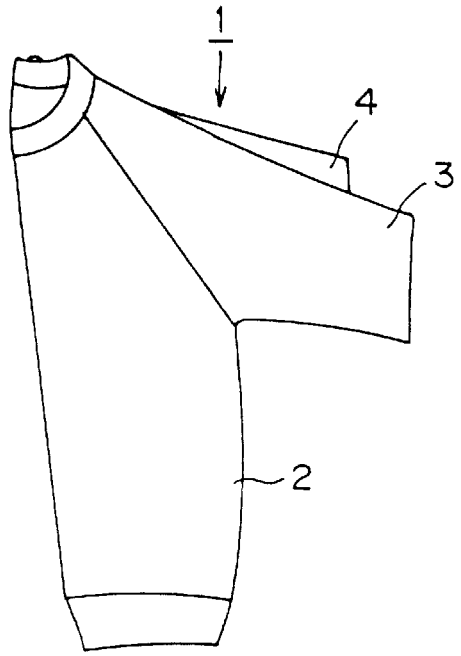

FIGS. 1A and 1B show a sweatshirt, where FIG. 1A shows its plane view with it being fully opened out and FIG. 1B shows its plane view with it being folded along its center line.

A sweatshirt 1 comprises a body 2 with a left sleeve 3 and a right sleeve 4 sewn thereto. That is, the left sleeve 3 and the right sleeve 4 protrude from the body 2. The length of the right sleeve 4 in this example is made to be about thirty percent [30%] shorter than that of the left sleeve 3 to suit a person having a most effective right arm. Accordingly, assuming that the length of the left sleeve 3 is set as about fifty centimeters [50 cm], the length of the right sleeve 4 should be set as about thirty five centimeters [35 cm]. Conversely, the length of the left sleeve 3 is made shorter than the right sleeve 4 to suit a person having a most effective left arm.

The sweatshirt 1 is made of a knitted fabric with its sleeves, collar and cuff conventionally cross-stitched.

Figure 2A:
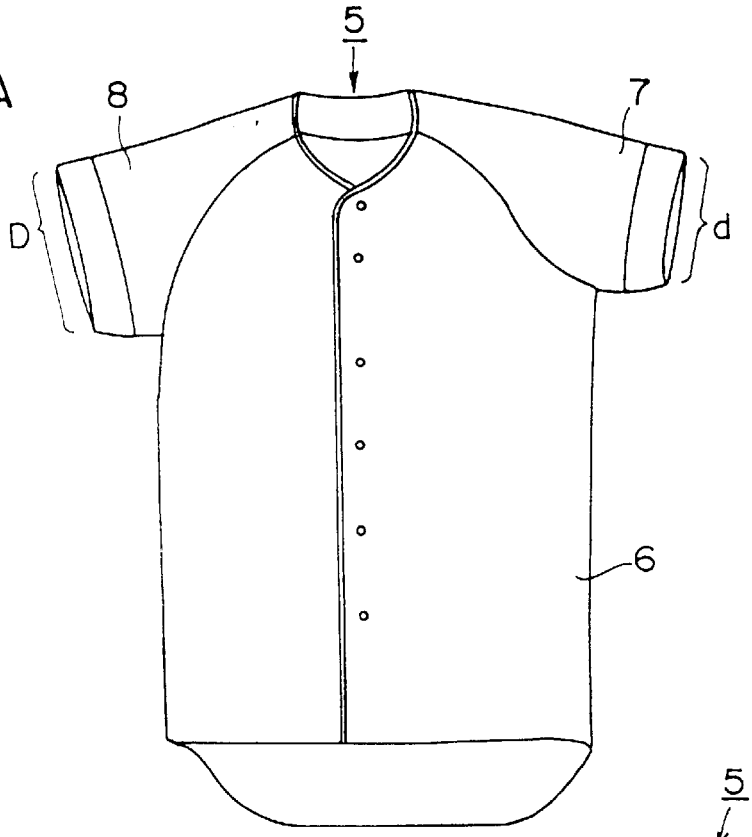
FIGS. 2A and 2B show an undershirt, where
Figure 2B:
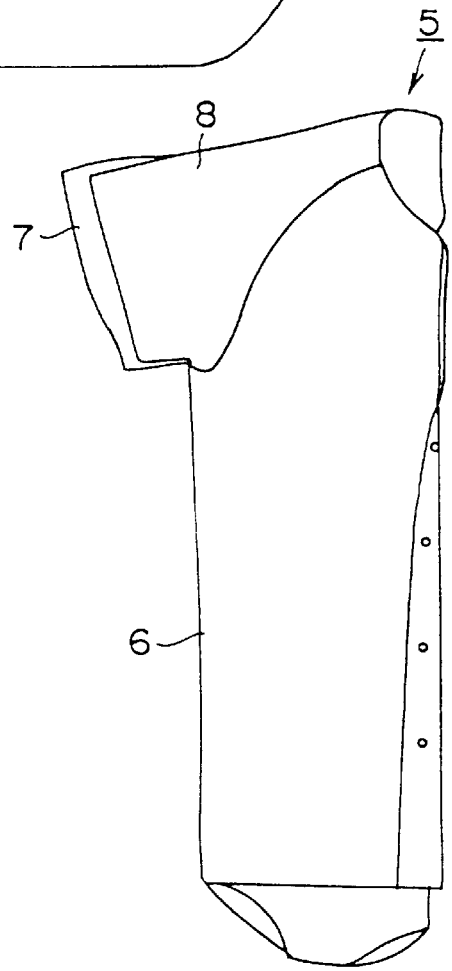

FIGS. 2A and 2B show an undershirt, where FIG. 2A shows its plane view with it being fully opened out and FIG. 2B shows its plane view with it being folded along its center line.

An undershirt 5 comprises a body 6 with a left sleeve 7 and a right sleeve 8 sewn thereto. That is, the left sleeve 7 and the right sleeve 8 protrude from the body 6. The length of the right sleeve 8 in this example is made to be about ten percent [10%] shorter than that of the left sleeve 9 to suit a person having a most effective right arm. Accordingly, assuming that the length of the left sleeve 9 is set as about twenty centimeters [20 cm], the length of the right sleeve 8 should be set as about eighteen centimeters [18 cm]. Conversely, the length of the left sleeve 7 is made shorter than the right sleeve 8 to suit a person having a most effective left arm. In addition, it may be useful that the diameter (D) of sleeve 8 is made larger than that (d) of sleeve 7 as shown in FIG. 2A.

The undershirt 5 is arranged to have buttons fixed the body 6.

Figure 3A:
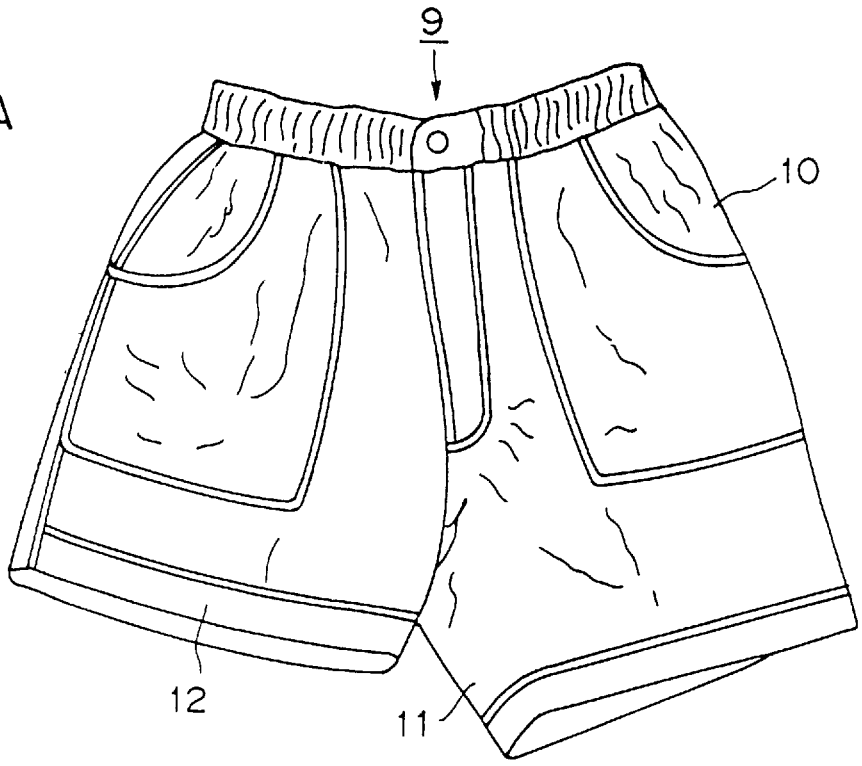
FIGS. 3A and 3B show a pair of shorts, where
Figure 3B:
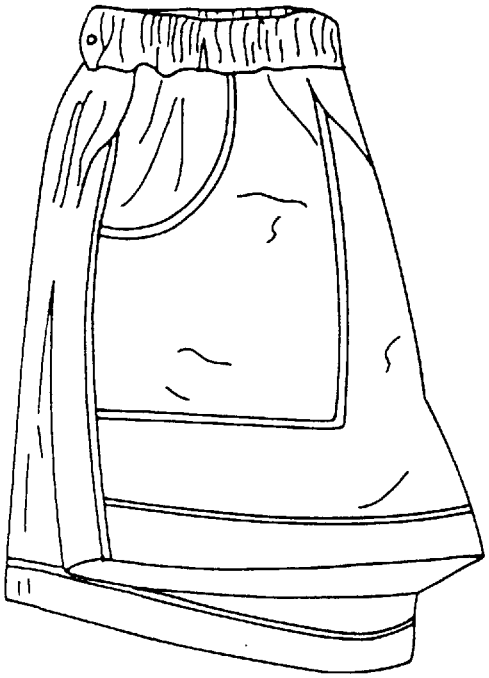

FIGS. 3A and 3B show a pair of shorts, where FIG. 3A shows its plane view with it being fully opened out and FIG. 3B shows its plane view with it being folded along its center line.

A pair of shorts 9 comprises an upper portion 10 with a left trouser leg 11 and a right trouser leg 12 sewn thereto. That is, the left trouser leg 11 and the right trouser leg 12 protrude from the upper portion 10. The length of the right trouser leg 12 in this example is made to be about twenty percent [20%] shorter than that of the left trouser leg 11 to suit a person having a most effective right leg. Accordingly, assuming that the length of the left trouser leg 11 is set as about seven centimeters [7 cm], the length of the right trouser leg 12 should be set as about five point six centimeters [5.6 cm]. Conversely,the length of the left trouser leg 11 is made shorter than the right trouser leg 12 to suit a person having a most effective left leg.

A top part of the upper portion 10 of the pair of shorts 9 comprises an elasticated band. The pair of shorts 9 has pockets on the left and right sides of the upper portion 10, for example.

Figure 4A:
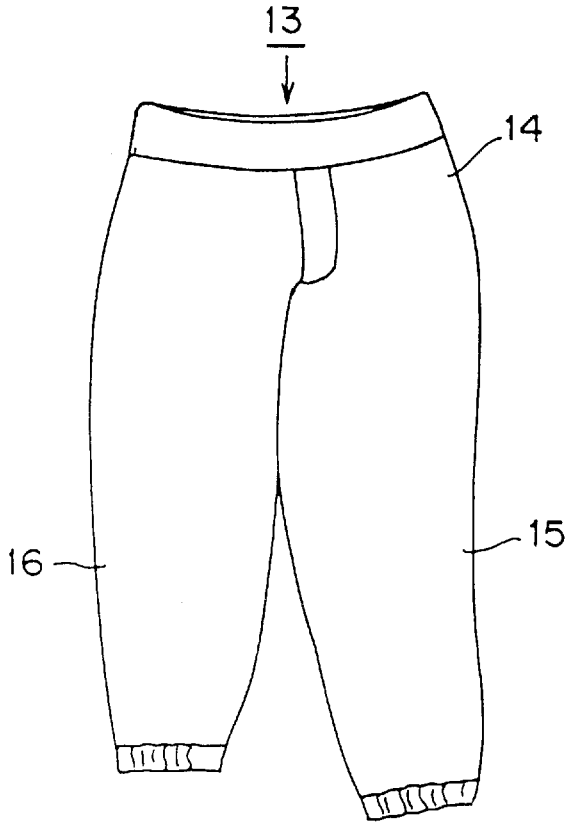
FIGS. 4A and 4B show a pair of training pants, 15 where
Figure 4B:
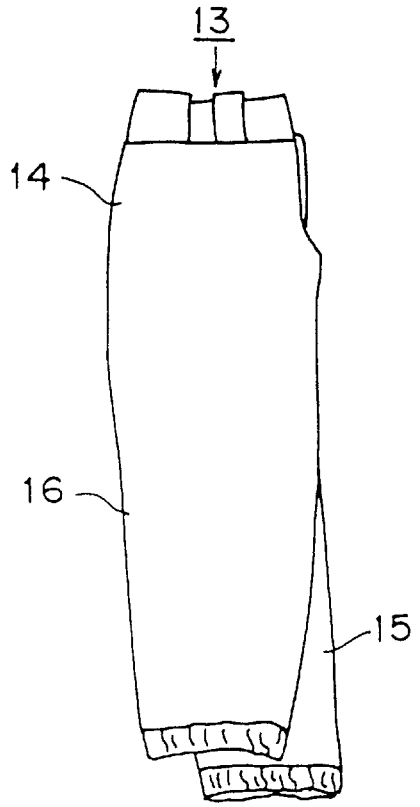

FIGS. 4A and 4B show a pair of training pants, where FIG. 4A shows its plane view with it being fully opened out and FIG. 4B shows its plane view with it being folded along its center line.

A pair of training pants 13 comprises an upper portion 14 with a left trouser leg 15 and a right trouser leg 16 sewn thereto. That is, the left trouser leg 15 and the right trouser leg 16 protrude from the upper portion 14. The length of the right trouser leg 16 in this example is made to be about twenty percent [20%] shorter than that of the left trouser leg 15 to suit a person having a most effective right leg. Accordingly, assuming that the length of the left trouser leg 15 is set as about eighty centimeters [80 cm], the length of the right trouser leg 16 should be set as about sixty four centimeters [64 cm]. Conversely the length of the left trouser leg 15 is made shorter than the right trouser leg 16 to suit a person having a most effective left leg.

A lower part (around the ankle) of each of the legs of the training pants 13 comprises an elasticated band. The pair of training pants 13 has belt holder loops around the top part of the upper portion 14, for example.

It goes without saying that clothes can be any combination of upper and lower body clothes to which any embodiment of this invention can be applied.

The difference between the left and right sleeves or trouser legs can be custom-tailored according to a user's specific requirements, which can be measured automatically, for example, by an appropriate combination of an image processing apparatus for analyzing the motion of his limbs, a cloth cutting apparatus best suited to cutting the required material, and a cloth sewing apparatus for sewing the required parts together.

As explained in detail above, this invention provides clothes which allow more freedom of movement for most effective limbs without having to roll-up a sleeve or a trouser leg every time on site. When a child wears clothes relating to this invention, one may also find them to be fashionable.

Although this invention has been described in its preferred forms with a certain degree of particularity, it is understood that the present disclosure of the preferred forms may be changed in details of construction and that the combination and arrangement of parts may be restored to without departing from the spirit and the scope of this invention as hereinafter claimed.

What is claimed is:

1. Pants suitable for a player in a sporting event, having an upper, permanently-seamed hip-encircling portion and permanently-seamed continuous tubular-shaped left and right leg-fitting portions of different lengths, wherein:

the shorter of said leg-fitting portions is made to be about twenty percent shorter than the longer of said leg-fitting portions;

each of said leg-fitting portions is constructed to encircle a leg of the player directly without another leg-fitting portion of the pants therebetween;

the shorter of said leg-fitting portions is tailored so as to facilitate free and unhindered motion of the most effective leg of a wearer when said pants are worn by a player, and the longer of said leg-fitting portions is tailored so as to provide protection to a leg therein when said pants are worn by a player;

whereby said leg-fitting portions are constructed so as to require less effort to be exerted by the most-effective leg of a player.

2. The pants according to claim 1, wherein said pants are a pair of shorts.

3. The pants according to claim 2, wherein:

said hip-encircling portion has an elasticated band around the top thereof.

4. The pants according to claim 3, wherein:

said hip-encircling portion has one or more pockets sewn thereto.

5. The pants according to claim 4, wherein:

said pants have a left side and a right side with at least one of said pockets sewn on one of said sides.

6. The pants according to claim 4, wherein:

said pants have a left side and a right side with at least one of said pockets sewn on each of said sides.

7. The pants according to claim 4, wherein:

said hip-encircling portion has an elasticated band around the top thereof; and said hip-encircling portion has a pocket on a left or right side thereof.

8. The pants according to claim 1, wherein:

said pants are a pair of training pants.

9. The pants according to claim 1, wherein:

said hip-encircling portion of said pants has a plurality of belt holder loops around the top thereof.

10. The pants according to claim 9, wherein:

said left and right leg-fitting portions of said pants have elasticated bands sewn around the distal ends thereof.

11. The pants according to claim 9, wherein:

said hip-encircling portion of said pants has a plurality of belt holder loops around the top thereof; and said left and right leg-fitting portions of said pants have elasticated bands sewn around the distal ends thereof.

12. The pants according to claim 1, wherein:

said shorter of said leg-fitting portions is tailored to have a larger diameter that the longer of said leg-fitting portions so that both leg-fitting portions are fitted to the legs of a wearer, and more effectively facilitate free and unhindered motion of the most effective leg of a player.

* * * * *